United States Patent [19]

Chenevard

[11] 4,246,740

[45] Jan. 27, 1981

[54] METHOD AND APPARATUS FOR FILLING A BOX WITH OBJECTS

[75] Inventor: Alexis Chenevard, Morges, Switzerland

[73] Assignee: Sapal Societe Anonyme des Plieuses Automatiques, Switzerland

[21] Appl. No.: 950,148

[22] Filed: Oct. 10, 1978

[30] Foreign Application Priority Data

Oct. 27, 1977 [DE] Fed. Rep. of Germany ..... 2748138

[51] Int. Cl.[3] ..... B65B 5/08; B65B 35/38

[52] U.S. Cl. ..... 53/448; 53/473; 53/543; 53/247

[58] Field of Search ..... 53/438, 436, 446, 448, 53/445, 474, 473, 467, 238, 240, 529, 523, 537, 538, 543, 544, 247, 249

[56] References Cited

U.S. PATENT DOCUMENTS

| | | | |
|---|---|---|---|
| 3,499,262 | 3/1970 | Thurston et al. | 53/527 |
| 3,735,556 | 5/1973 | Dille et al. | 53/240 |
| 4,048,780 | 9/1977 | Chenevard | 53/448 |
| 4,151,698 | 5/1979 | Müller et al. | 53/240 X |

FOREIGN PATENT DOCUMENTS

| | | | |
|---|---|---|---|
| 2601832 | 7/1977 | Fed. Rep. of Germany | 53/443 |

*Primary Examiner*—Horace M. Culver

*Attorney, Agent, or Firm*—Stevens, Davis, Miller & Mosher

[57] ABSTRACT

An apparatus for filling a box with objects, such as praline assortments, comprises an insertion plate having compartments into which the objects can fit, each compartment having an apertured base, and a table for receiving the insertion plate. The table has a plurality of plungers, one associated with each compartment, each having a shape inversely corresponding to the shape of the aperture of the associated compartment. The plungers are movable simultaneously to push the objects from the insertion plate and a suction device holds the objects above the plate while movable walls compress the objects into a space corresponding to the internal area of the box. The suction device, walls and held objects are then moved as a unit to a filling station and deposited in the box at the station.

3 Claims, 8 Drawing Figures

METHOD AND APPARATUS FOR FILLING A BOX WITH OBJECTS

Figure 1:
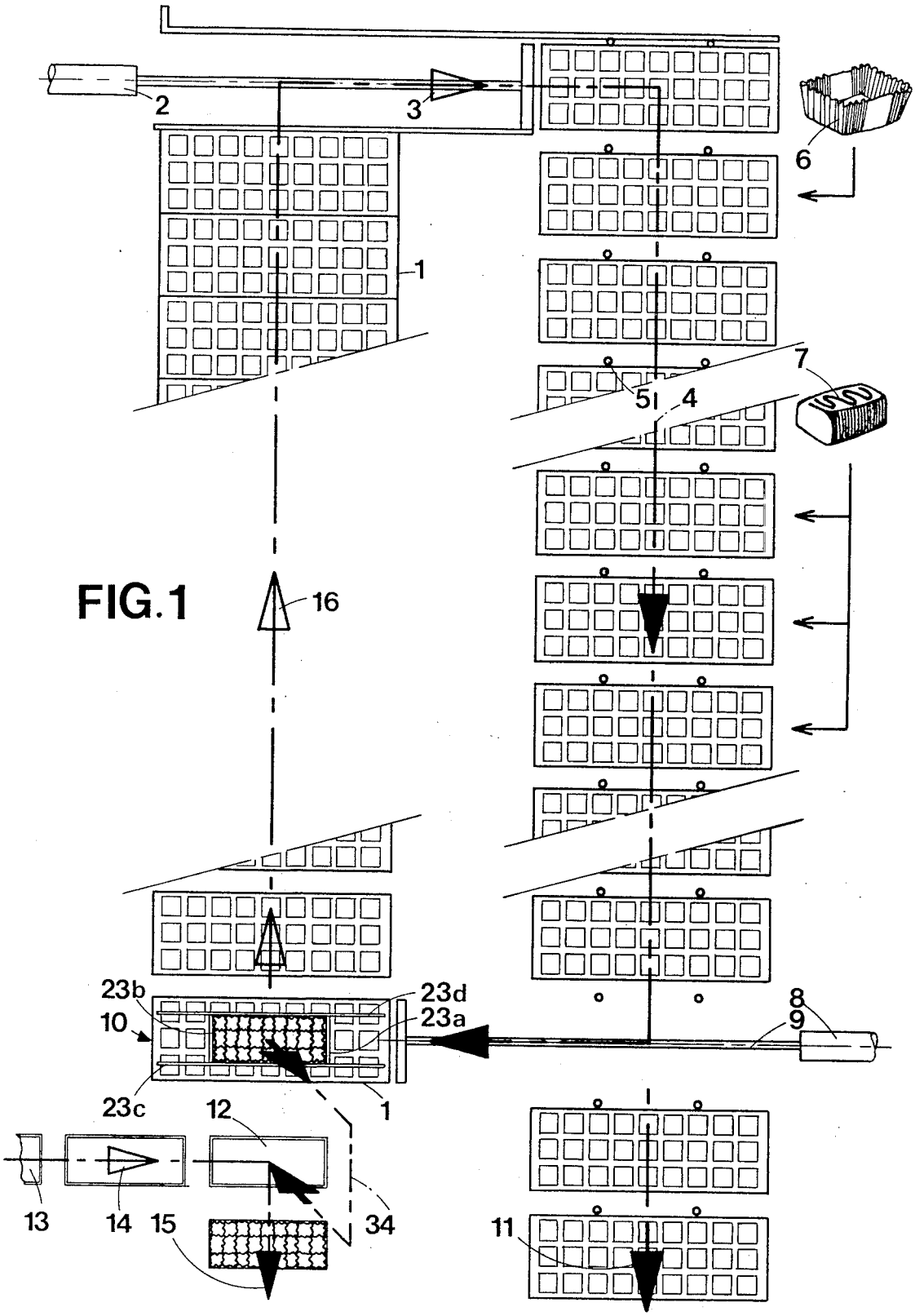
Figure 2A:
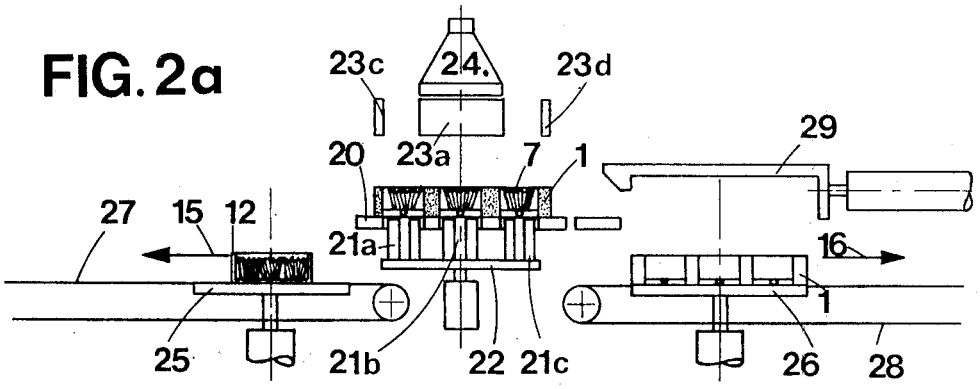
Figure 2B:
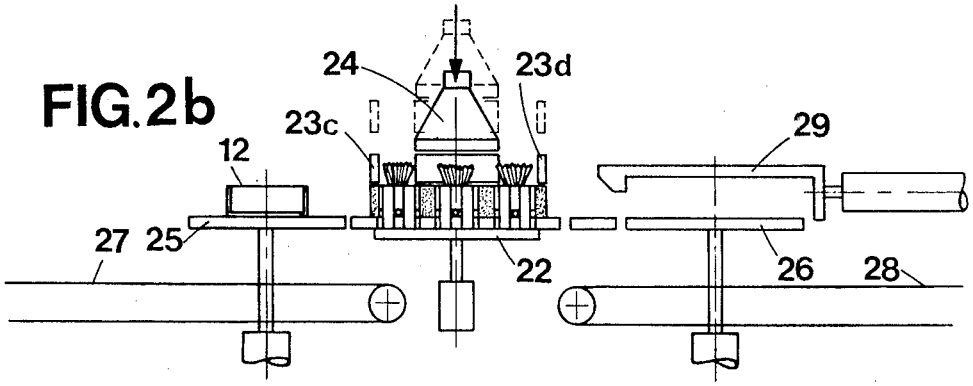
Figure 2C:
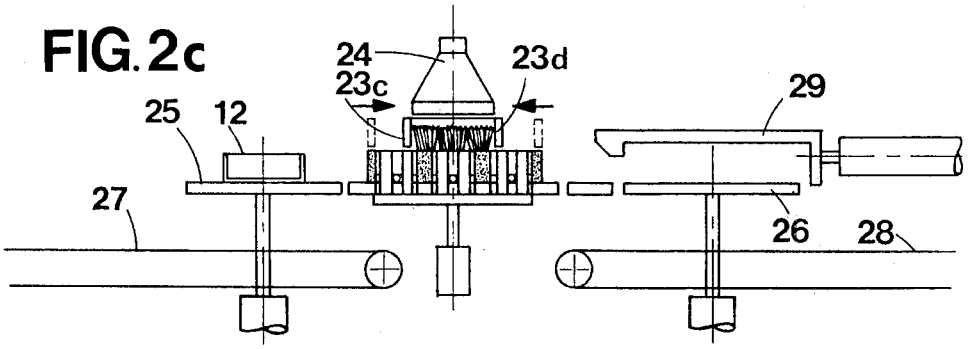
Figure 2D:
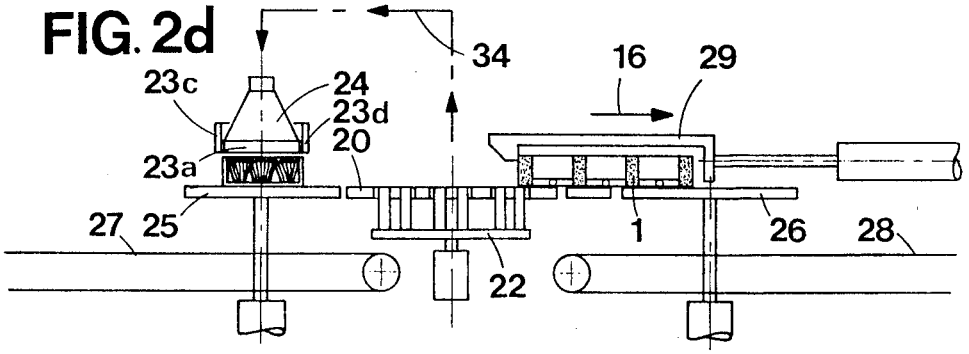

The invention relates to a method and apparatus for filling a box with objects, such as assortments of sweets.

An earlier proposal described in German Pat. No. 26 48 721 relates to a method and apparatus for filling a box with objects, in particular praline assortments, in which the objects are first introduced into an insertion plate and held on a table by suction, whereupon the insertion plate is removed for reuse, movable walls are placed around the objects on the table, the movable walls then being advanced towards the objects in order to compress them into a space corresponding to the internal area of a box for containing the objects, and then the objects are simultaneously laid in the box as an assembly.

Furthermore German Pat No. 26 01 832 describes a method and apparatus for forming a collective package of objects from the food industry, in particular sweetmeats such as pralines, biscuits or the like, which are each individually surrounded by a normally expanded sheath or case and housed in a common packaging box, in which a number of expanded cases corresponding to the number of sweetmeats contained in a packing layer are placed according to the packing level in a plane loosely next to each other and one behind the other, a sweetmeat is introduced into each case, and then the whole assembly of packed articles is compressed to the internal dimensions of the box against the expansion force of the cases and in this state introduced into the box.

The object of the present invention consists in improving these earlier methods and apparatuses in such a way that the objects are continuously guided and held positively.

In accordance with one aspect of the present invention, there is provided a method of filling a box with objects, such as praline assortments, comprising the steps of first introducing the objects into an insertion plate and retaining said plate on a table, simultaneously pushing the objects upwards from below, using one plunger for each object, out of the insertion plate, holding the objects from above by a suction device, removing the insertion plate for re-use, placing movable walls around the objects and advancing the walls towards the objects to urge the objects together into a space corresponding to the internal area of the box into which the objects are to be placed, and introducing simultaneously into the box all the objects held by the suction device.

In accordance with another aspect of the invention, there is provided an apparatus for filling a box with objects, comprising insertion plates having compartments for holding the objects for filling a box, each compartment having an apertured base, a table for holding a filled insertion plate, a plurality of plungers, one associated with each compartment and being of shape inversely corresponding to the aperture of the associated compartment, means for simultaneously displacing all the plungers upwards to the objects out of the insertion plate, a suction device above the table for holding the objects by an upwardly directed suction force, and movable walls which can be placed around the objects when moved out of the insertion plate for compressing the objects into a space corresponding to the internal surface area of the box to be filled, wherein the assembly composed of suction device, walls and objects is movable as a unit to a station at which the objects can be deposited simultaneously in the box.

Figure 3:
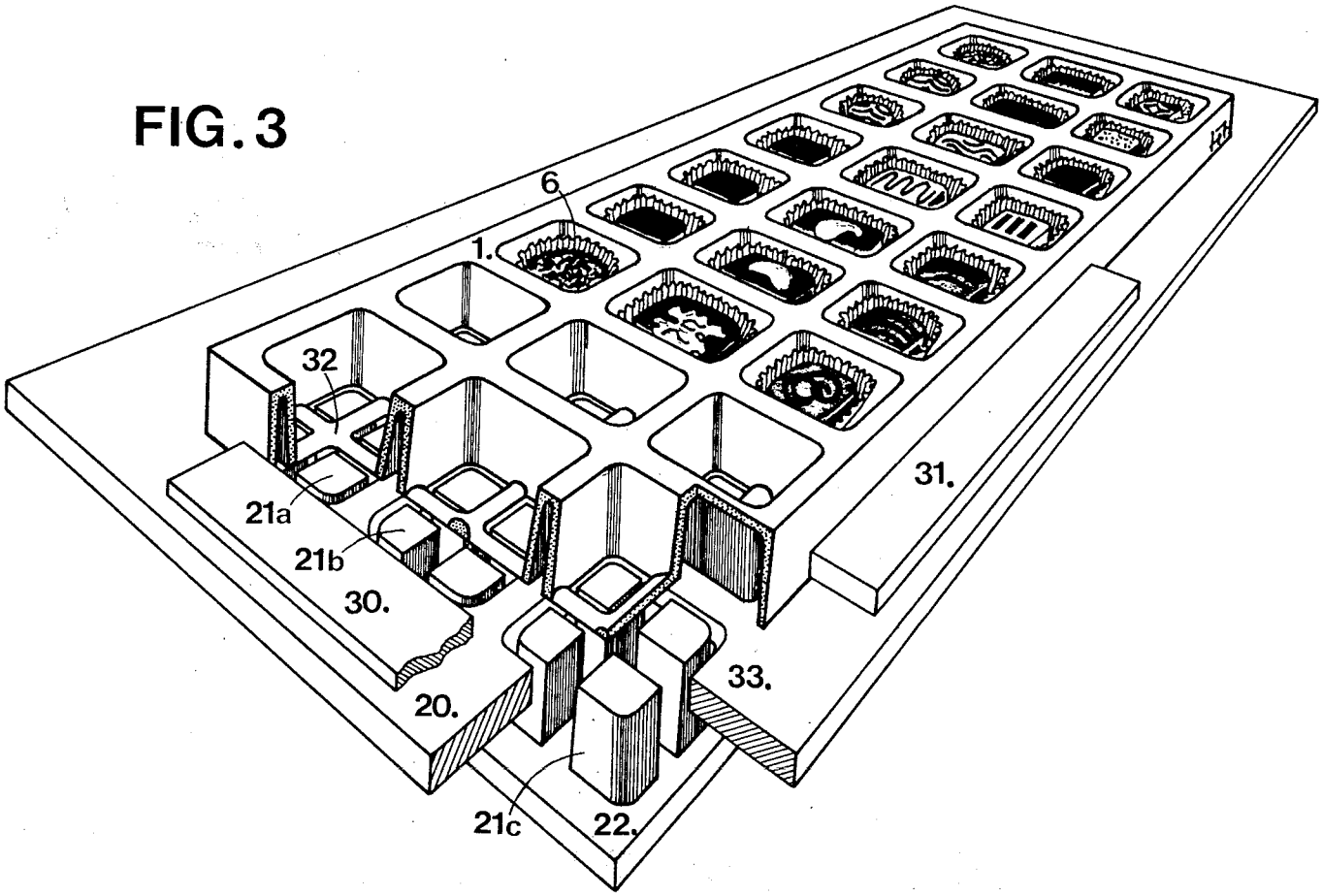
Figure 4:
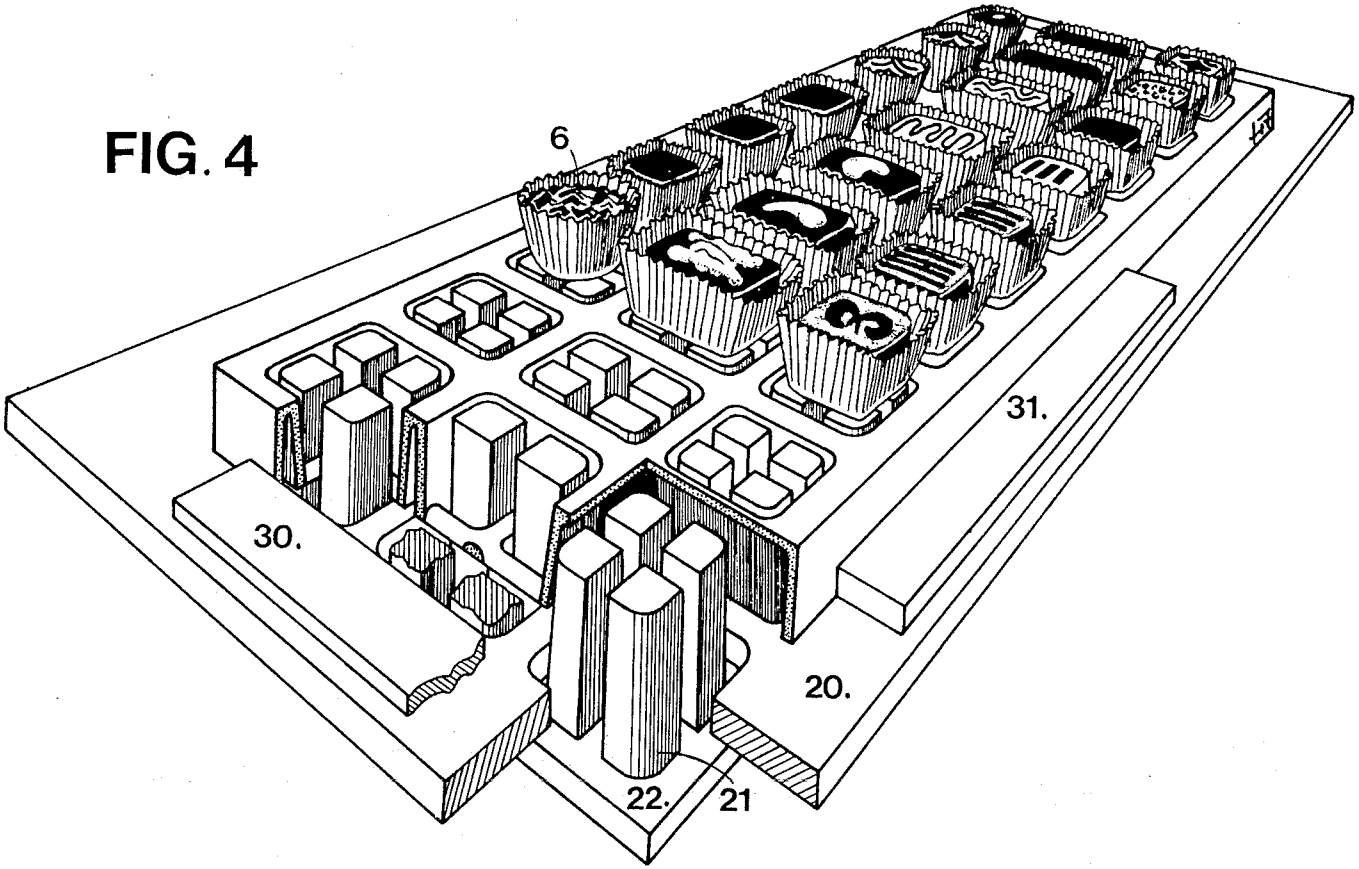
Figure 5:
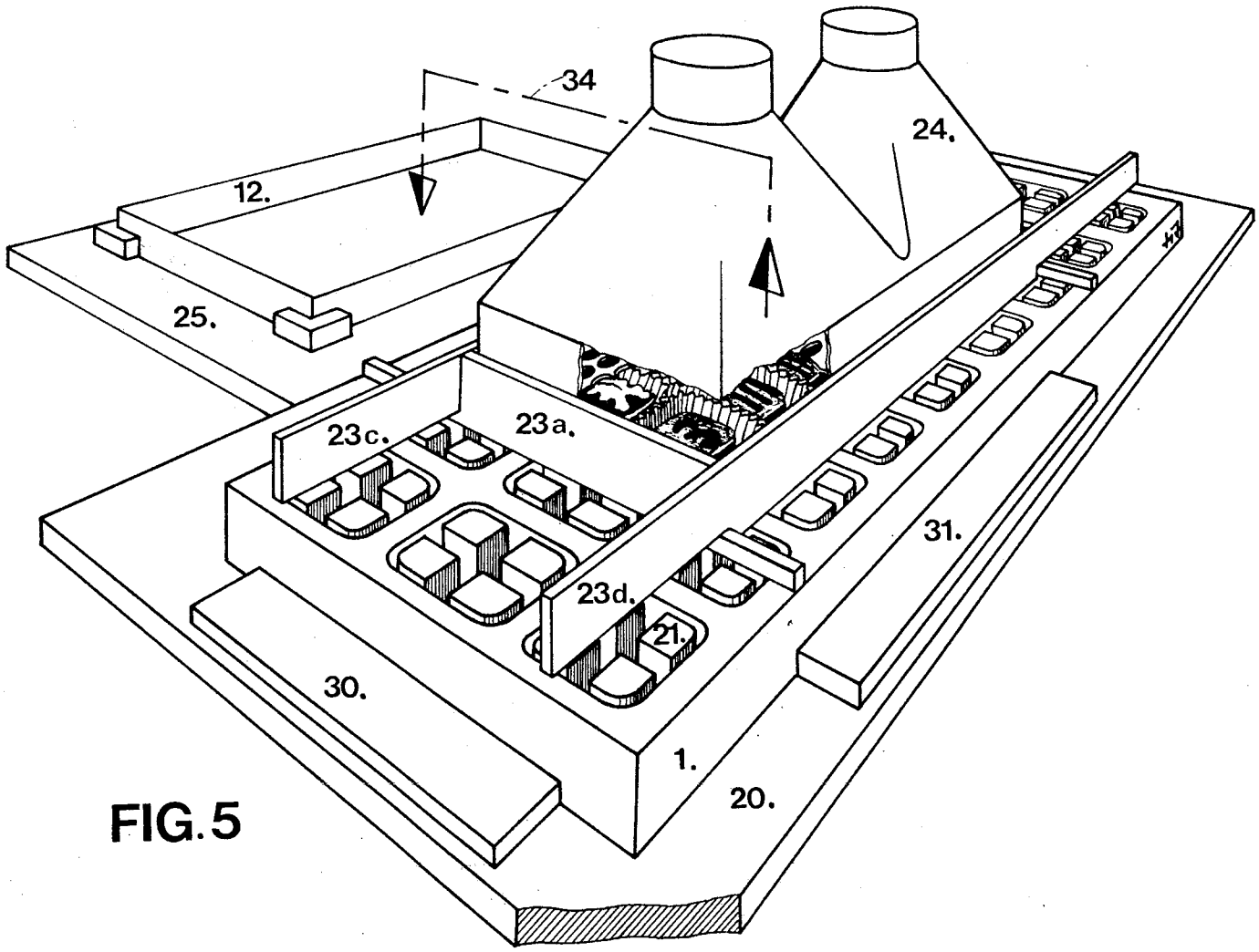

An apparatus in accordance with the invention for filling boxes with pralines will now be described, by way of example, with reference to the accompanying drawings, in which:

FIG. 1 is a schematic plan view of the apparatus illustrating the work cycle for filling boxes with pralines, FIGS. 2*a*–2*d* are respectively schematic side views of the apparatus in four successive stages of operation, and FIGS. 3–5 are respectively schematic perspective views of three successive stages of operation of certain components of the apparatus.

Before the details of the apparatus are discussed, the cycle for filling a box with different pralines will first be explained briefly with reference to FIG. 1.

Empty insertion plates 1 are intermittently conveyed by means of a device 2 in known manner in the direction of arrow 3 into the position shown at the top right in FIG. 1. From there, the empty insertion plates are moved progressively by means of driver pins 5 mounted on an endless chain along a row of filling stations. In the process, empty cases 6 are first introduced into respective compartments in the insertion plates in two, three or more stations, then pralines 7 are introduced into the empty cases in several successive stations. There are as many stations as there are kinds of praline to be introduced per insertion plate. Of course, it is possible to introduce certain pralines together with their cases, and not separately from them, into the insertion plates.

The completely filled insertion plates 1 are intermittently moved from a known device 8 in the direction of arrow 9 to a device 10 which is described in detail below. The device 10 has a capacity which is not normally sufficient to hold all the full insertion plates, so further full insertion plates are passed in the direction of arrow 11 to a second device 10 and, if necessary, to third and fourth devices 10, which can take place by means of known deflectors.

In the device 10, the cases with the pralines are ejected from the insertion plates, compressed to the dimensions of the boxes and introduced into empty boxes which are moved by means of an intermittently operating device 13 in the direction of arrow 14 into the device 10, then conveyed out of the latter, when filled, in the direction of arrow 15. The empty insertion plates 1 are guided out of the device 10 in the direction of arrow 16 back to the beginning of the apparatus. All transport means may be constructed in a known manner, e.g. as endless revolving belts, cables or chains.

Details of the device 10 are now explained with the aid of FIGS. 2*a*–2*d*.

The device 10 comprises a table 20 with recesses, onto which the filled insertion plates 1 are displaced perpendicularly to the drawing plane in the direction of arrow 9 (FIG. 1).

Beneath the table 20 are disposed plungers 21*a*, 21*b* and 21*c* which extend into the recesses in the table 20 and which can be moved together vertically up and down through the recesses in the table 20 by means of a plate 22.

Above the table 20 are four movable walls 23*a*, 23*b*, 23*c* and 23*d* and a suction device 24. To the left of these components is a table 25 for the boxes 12 and to the right is a table 26 for the insertion plates 1, both tables 25, 26 being movable up and down. Table 25 moves between two conveyor belts 27, and table 26 moves between two conveyor belts 28. Over the table 26 is disposed an extractor 29 for the empty insertion plates 1.

In FIGS. 3–5, it can be seen that the insertion plates 1 are located on the table 20 by means of stops 30 and 31. Further, in these figures it can be seen that the bottom 32 of each recess in the insertion plate has a cruciform shape. The cruciform 32, which act as supports, could also be of a different geometrical shape, for example a three-point or multi-point star. The plungers 21 have vertical recesses 33 corresponding to the geometrical shape of the bottom supports 32. In particular it can be seen from FIG. 3 that the recesses in the plates 1 for holding the cases with the pralines do not all have to be the same geometrical shape, but may be constructed differently according to whether large or small pralines must be received. In the example shown, all the openings are rectangular or square in cross-section, which provides advantages on the grounds of space in the filled box 12. It is however clear that openings of round cross-section for round cases could also be provided.

In FIGS. 3 and 4, the first two rows of the plate are shown unfilled for greater clarity, but it is clear that these rows are also filled in operation.

The illustrated device 10 operates as follows:

In the operating stage as in FIGS. *2a* and 3, a filled plate is located on the table 20, while a full box 12 is moved in the direction of arrow 15 by belts 27 and an empty plate 1 is moved in the direction of arrow 16 by belts 28. The movable walls 23 and the suction device 24 are located in their starting positions.

In the following operating stage (FIGS. *2b* and 4), the plate 22 has moved the plungers 21 upwards and displaced the cases with the pralines out of the plate 1. At the same time, the walls 23 have been placed around the free cases, and the tables 25 and 26 are now located in their upper positions. On table 25 now lies an empty box 12 which has approached from behind in the direction of arrow 14 (FIG. 1) perpendicular to the drawing plane (FIG. *2b*).

Then follows the next stage (FIGS. *2c* and 5). It can be seen that the movable walls 23 have now compressed the cases with the pralines to the box dimensions and that the suction device 24 is fully lowered.

In the last operating stage shown (FIG. *2d*), the suction device 24 which holds the compressed pralines by suction, together with the movable walls 23, has moved along arrow 34 first vertically upwards, then horizontally to the left, then vertically downwards over the empty box 12. After this, the movable walls 23 are displaced upwards and the suction effect is eliminated, so that the pralines now remain in the box 12. In the meantime, the extractor 29 has drawn the empty plate over the table 26, while the plate 22 has moved the plungers 21 downwards into their starting positions.

When this stage is completed, all elements return to the position shown in FIG. *2a*.

It is possible to fill an empty box 12 with not just a single layer of pralines, but also two layers one above the other. In this case, the box 12 remains on the table 25 for twice as long. After filling with the first layer a cardboard blank for example is placed on this layer using known means.

What is claimed is:

1. A method of filling a box with objects, comprising the steps of first introducing the objects into an insertion plate and retaining said plate on a table, pushing simultaneously the objects upwards from below, using one plunger for each object, out of the insertion plate, holding said objects from above by a suction device, removing said insertion plate for re-use, placing movable walls around said objects and advancing said walls towards said objects to urge said objects together into a space corresponding to the internal area of said box into which said objects are to be placed, and introducing simultaneously into said box all said objects held by said suction device.

2. An apparatus for filling a box with objects at a filling station, comprising insertion plates having compartments for holding said objects, each compartment having a base and means defining an aperture in said base, a table for holding an insertion plate filled with said objects, a plurality of plungers, one associated with each said compartment and being of shape inversely corresponding to said aperture of said associated compartment, means for simultaneously displacing all said plungers upwards to push said objects out of said insertion plate, a suction device above said table for holding said objects by an upwardly directed suction force, and movable walls which can be placed around said objects when said objects are moved out of said insertion plate, said walls being arranged to compress said objects into a space corresponding to the internal surface area of said box, said suction device, said walls and said objects forming an assembly which is movable as a unit to said filling station at which said objects can be deposited simultaneously in said box.

3. An apparatus according to claim 2, including a transport device for returning said insertion plates to a starting point of a work cycle subsequent to the removal of said objects therefrom.

* * * * *